US008893775B2

(12) United States Patent
Bjoroy et al.

(10) Patent No.: US 8,893,775 B2
(45) Date of Patent: Nov. 25, 2014

(54) MULTIPLE ELECTRIC SUBMERSIBLE PUMP SYSTEM

(75) Inventors: Robin Bjoroy, Bristol (GB); Steven Wilson, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 632 days.

(21) Appl. No.: 12/876,869

(22) Filed: Sep. 7, 2010

(65) Prior Publication Data

US 2011/0056699 A1 Mar. 10, 2011

Related U.S. Application Data

(60) Provisional application No. 61/240,520, filed on Sep. 8, 2009.

(51) Int. Cl.

| | |
|---|---|
| ***E21B 43/01*** | (2006.01) |
| ***F04B 23/04*** | (2006.01) |
| ***F04B 47/06*** | (2006.01) |
| ***E21B 43/12*** | (2006.01) |

(52) U.S. Cl.

CPC ..... *E21B 43/01* (2013.01); *F04B 47/06* (2013.01); *F04B 23/04* (2013.01); *E21B 43/128* (2013.01)

USPC ..... 166/105; 166/68; 166/66.4; 417/423.5; 417/423.3

(58) Field of Classification Search

USPC ..... 166/105, 68; 417/423.5, 423.3

See application file for complete search history.

(56) References Cited

U.S. PATENT DOCUMENTS

| | | | | |
|---|---|---|---|---|
| 3,292,695 | A * | 12/1966 | Haeber | 166/352 |
| 6,299,672 | B1 | 10/2001 | Rivas | |
| 6,790,017 | B2 * | 9/2004 | Takura et al. | 417/423.5 |
| 7,314,084 | B2 | 1/2008 | Rodrigues | |
| 7,914,266 | B2 * | 3/2011 | Kerr et al. | 417/410.1 |
| 2005/0034871 | A1 | 2/2005 | Scarsdale | |
| 2005/0217857 | A1 * | 10/2005 | Rodrigues et al. | 166/351 |
| 2006/0162934 | A1 * | 7/2006 | Shepler | 166/370 |
| 2009/0032264 | A1 | 2/2009 | Shepler | |

FOREIGN PATENT DOCUMENTS

WO WO 2007026142 A1 * 3/2007

* cited by examiner

*Primary Examiner* — Kenneth L Thompson
(74) *Attorney, Agent, or Firm* — Michael Stonebrook

(57) ABSTRACT

An electric submersible pump ("ESP") module is disclosed for producing fluids from subsea wells. The ESP module includes at least two ESPs positioned side by side and connected in parallel to discharge into a common manifold. The ESPs and manifold can be enclosed in a housing and deployed to a subsea location. At the subsea location, the ESP module can be operationally connected to an electric source, the production fluid, and to an export conduit. The production fluid from the well(s) is drawn from within the housing into one or more of the at least two ESPs which energize and discharge the production fluid into the manifold and through the export conduit to a collection point. Each of the ESPs may be selectively operated to provide the desired flow rate and/or lifting head.

18 Claims, 2 Drawing Sheets

MULTIPLE ELECTRIC SUBMERSIBLE PUMP SYSTEM

RELATED APPLICATIONS

This application claims the benefit of U.S. Provisional Patent Application No. 61/240,520, filed on Sep. 8, 2009, the contents of which are hereby incorporated by reference.

BACKGROUND

This section provides background information to facilitate a better understanding of the various aspects of the present invention. It should be understood that the statements in this section of this document are to be read in this light, and not as admissions of prior art.

The present invention relates generally to enhancements in boosting of hydrocarbons from a subsea production well, and more particularly to a system for producing hydrocarbons comprising at least two electric submersible pumps connected in parallel through a common production manifold.

A wide variety of systems are known for producing fluids of economic interest from subterranean geological formations. In formations providing sufficient pressure to force the fluids to the earth's surface, the fluids may be collected and processed without the use of artificial lifting systems. Where, however, well pressures are insufficient to raise fluids to the collection point, artificial means are typically employed, such as pumping systems.

The particular configurations of an artificial lift pumping systems may vary widely depending upon the well conditions, the geological formations present, and the desired completion approach. In general however, such systems typically include an electric motor driven by power supplied from the earth's surface. The motor is coupled to a pump, which draws wellbore fluids from a production horizon and imparts sufficient head to force the fluids to the collection point. Such systems may include additional components especially adapted for the particular wellbore fluids or mix of fluids, including gas/oil separators, oil/water separators, water injection pumps, and so forth.

One such artificial lift pumping system is an electrical submersible pump ("ESP"). An ESP typically includes a motor section, a pump section, and a motor protector to seal the clean motor oil from wellbore fluids, and is deployed in a wellbore where it receives power via an electrical cable. An ESP is capable of generating a large pressure boost sufficient to lift production fluids even in ultra deep-water subsea developments. Accordingly, there exists a continuing need to provide subsea pumping systems that provide demanding flow rates and lifting head in an advantageous manner.

SUMMARY

A multiple electric submersible pump ("ESP") system, according to one or more aspects of the present disclosure comprises a first ESP having an intake and a discharge; and a second ESP having an intake and a discharge, wherein the first ESP discharge and the second ESP discharge are connected in parallel to a common manifold. The ESPs can be secured side by side together to form a bundle. The ESPs can be disposed in a housing. The housing can be adapted to fluidicly connect, for example subsea, to the production fluid. In an embodiment, the housing comprises a power head to connect, subsea, an electrical source to the ESPs.

A method according to one or more aspects of the present disclosure for pumping a production fluid from a subsea environment comprises hydraulically connecting multiple ESPs in parallel to a common manifold; enclosing the multiple ESPs and the common manifold into a housing forming an ESP module; deploying the ESP module to a subsea location; fluidicly connecting, subsea, the production fluid to the ESP module; and pumping the production fluid into the common manifold and to a collection point remote from the ESP module using the multiple ESPs. In some embodiments, the multiple ESPs are connected in parallel at a location, for example onshore, that is remote from the offshore subsea production fluid source. In some embodiments the ESP module is assembled at a location, for example onshore, that is remote from the offshore subsea production fluid source.

Another embodiment of method for subsea fluid production includes securing a first ESP and a second ESP side by side to form a bundle, wherein each of the ESPs include a pump having an intake and a discharge, and an electric motor; connecting the discharges of the first ESP and the second ESP in parallel to a manifold; enclosing the ESP bundle and the manifold in a housing to form an ESP module; deploying the ESP module at a subsea location; directing a production fluid into the housing; drawing the production fluid from inside of the housing into the intakes of the first ESP and the second ESP; and pumping the production fluid from both of the discharge of the first ESP and the discharge of the second ESP into the manifold and to a collection location remote from the ESP module.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
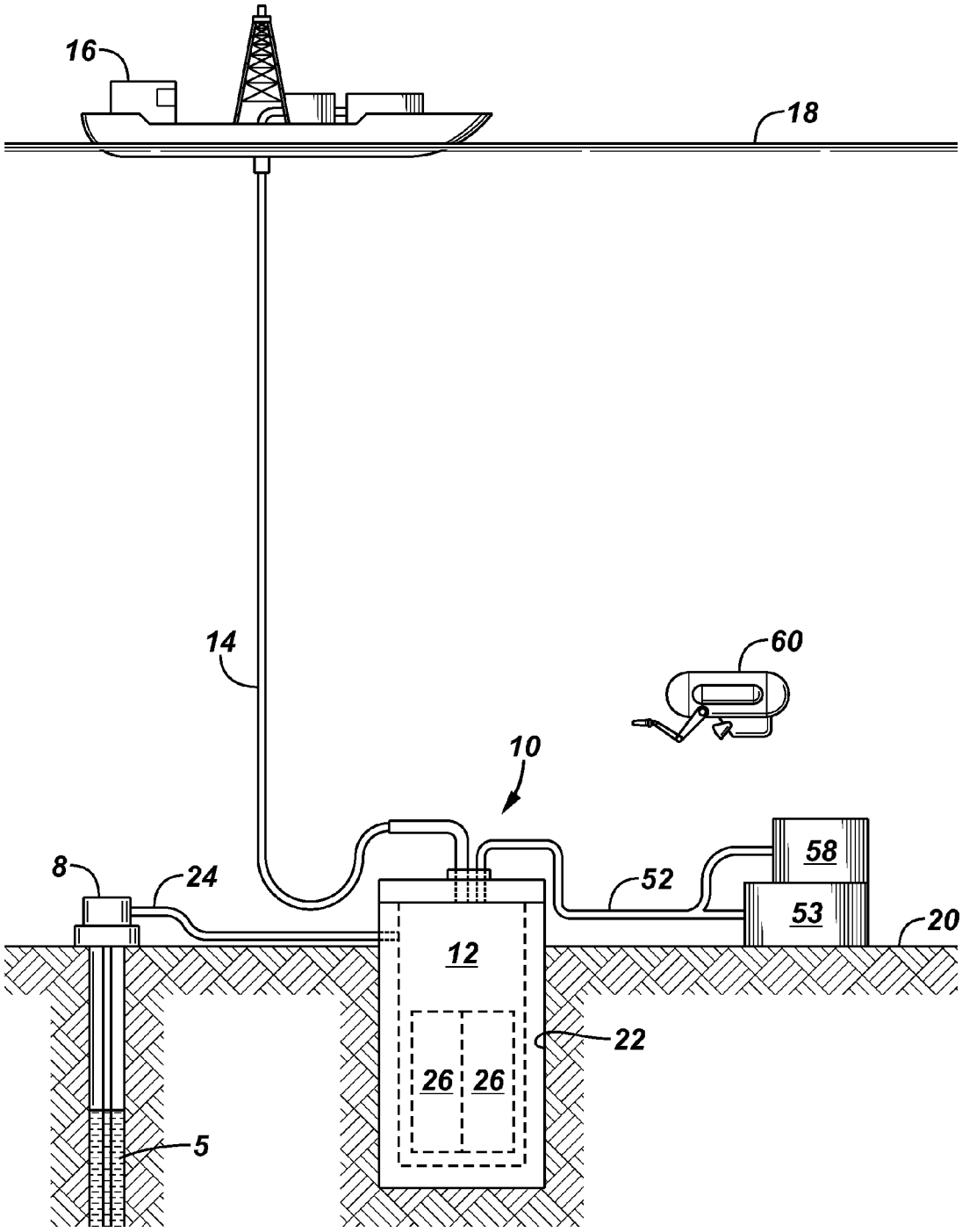
FIG. 1 is a schematic elevation view of an embodiment of a multiple electric submersible pump system according to one or more aspects of the present disclosure disposed in a subsea environment.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In the specification and appended claims, the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly described some embodiments. However, when applied to equipment and methods for use in wells that are deviated or horizontal, such terms may refer to a left to right, right to left, or other relationship as appropriate.

According to one or more aspects of the present disclosure, the system addresses the need for increased production rate (e.g., flow rate) and/or lifting head from the subsea pumping system by connecting multiple electrical submersible pumps ("ESP") in parallel to a common gathering (e.g., production) manifold. In some embodiments, the ESPs are provided as a module. The ESP module can be deployed into a producing well, a caisson type unit located proximate to the producing well(s), and in some embodiments on the seabed adjacent to the producing well(s). According to one or more aspects, the ESP module presents a reduced length pump compared to a conventional single ESP configured to provide the same lifting head, flow rate and power. The reduced length of the ESP module may increase the applications in which the system can be assembled offsite and then transported (e.g., via roadway and/or water) to the well location, thereby minimizing the risks and costs of offshore assembly and servicing. Embodiments of the system can provide economic benefits, for example in seabed caisson applications wherein conventional well control is not required and the ESP module may be installed from a vessel or from the drilling or production platform. Again as a shorter length unit relative to a similar capacity conventional ESP unit, the ESP module may enable installation from a lower classification of vessel without requiring specialized surface handling equipment. Additional, some embodiments of the ESP module can be installed through a conventional blowout preventer ("BOP"), for example for deploying the ESP module in the producing well.

FIG. 1 is a schematic elevation view of an illustrative embodiment of a multiple ESP system (e.g., pump system), generally denoted by the numeral 10, for lifting a production fluid (e.g., oil, gas, water, or combination) from one or more wells 8. System 10 comprises an ESP module 12 for receiving the production fluid 5 from one or more subsea production wells 8 and lifting the production fluid 5 via an export conduit 14 (e.g., pipe, riser) to a collection point 16 located at the water surface 18. Collection point 16 is depicted in FIG. 1 as a platform from which drilling operations can be conducted. It will be recognized by those skilled in the art with benefit of this disclosure that collection point 16 may be provided on other water based platforms (e.g., ship, barge, rig, production platform) as well as be a land based location.

ESP module 12 comprises a plurality (e.g., multiple, two or more) electrical submersible pumps 26. Pump system 10 is depicted in FIG. 1 deployed in a caisson type application, wherein ESP module 12 is at least partially disposed (e.g., positioned) into the seabed 20. In the depicted embodiment, ESP module 12 is disposed in a borehole 22, which may be, for example, a cased "dummy" well, or other caisson (e.g., cement and/or metal lined chamber) type installation; and ESP module 12 is in fluid connection to production well 8 via an inflow conduit 24. According to one or more aspects, borehole 22 can be the production well 8. In still further embodiments, pump system 10 can be arranged on seabed 20 adjacent to production well 8.

Figure 2:
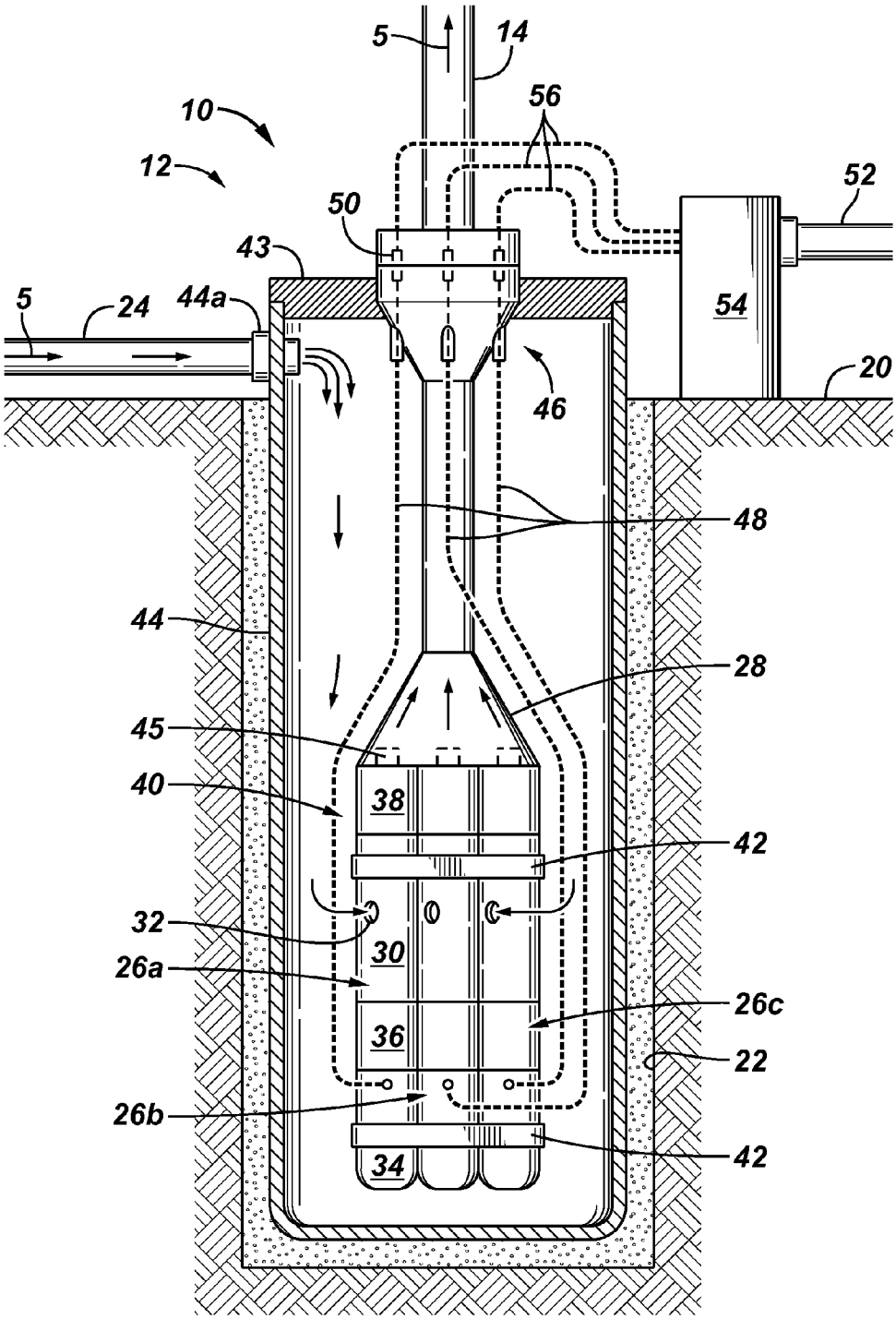
FIG. 2 is an enlarged schematic view of an embodiment an ESP module comprising three ESPs connected in parallel to discharge to a common gathering manifold according to one or more aspects of the present disclosure.

FIG. 2 is an enlarged schematic view of an illustrative embodiment of ESP module 12 according to one or more aspects of the present invention disposed at least partially in seabed 20. In the depicted embodiment, ESP module 12 is disposed in a borehole 22 (e.g., caisson) formed in seabed 20. ESP module 12 comprises multiple electrical submersible pumps ("ESP"), generally denoted by the numeral 26, and from time to time individually referenced with subscripts a, b, c, etc. (26*a*, 26*b*, . . . ), for example as depicted in FIG. 2. ESPs 26 are fluidicly connected in parallel to a common gathering manifold 28 which is in fluid connection with export conduit 14 (see FIG. 1). ESPs 26 may be a centrifugal type, progressing cavity type, or some other form. In the depicted embodiment, ESPs 26 are centrifugal type pumps which can comprise various ESP components and/or stages. For example, as depicted in FIG. 2, each ESP 26*a*, 26*b*, 26*c* comprises a pump 30, a pump intake 32, an electric motor 34, a motor protector 36, and a pump discharge 38 to direct the production fluid energized by pump 30 (e.g., ESP 26) into common gathering manifold 28 and export conduit 14. In the depicted embodiment, multiple ESPs 26*a*, 26*b*, 26*c* are physically secured together to form a bundle 40 and may be secured, for example, with one or more mechanical connectors 42 (e.g., clamps, straps, etc.). According to one or more aspects of the invention, the multiple ESPs 26 are secured side by side, forming an axially compact, or shorter length pump relative to a single ESP having an equivalent capacity (e.g., flow rate and lifting head). In an embodiment of the invention, the axially compact ESP bundle 40 can be assembled at a location remote (e.g., offsite) from the well site (e.g., collection point 16, water surface location, subsea) then transported on roadways (e.g., by truck) to a port for continued transportation to the offshore well site by a sea vessel. Similarly, in some embodiments ESP module 12, further described below, can be assembled at location remote from the well site and then transported via roadway and/or water to the well site where it can be deployed subsea.

Depicted ESP module 12 comprises a sealed housing 44 (e.g., can, pod, or capsule) in which ESP bundle 40 is disposed (e.g., contained, enclosed). In the depicted embodiment, housing 44 comprises a cap 43 for closing, and in some embodiments fluidicly sealing, ESPs 26 inside of housing 44. Housing 44 is adapted to fluidicly connect inflow conduit 24, for example at inflow port 44*a*. Inflow port 44*a* can be adapted to promote connecting inflow conduit 24 via a remotely operated vehicle. Similarly, housing 44 is adapted to facilitate subsea connection of export conduit 14 to manifold 28 and the contained ESPs, for example through module head 46 by a remotely operated vehicle. In an embodiment, for example as shown in FIG. 2, production fluid 5 enters ESP module 12 through inflow conduit 24 where it is drawn into pump intake 32 of each operating ESP 26*a*, 26*b*, 26*d*. Respective pumps 30 impart energy to the fluid which is discharged into common gathering manifold 28 and into export conduit 14. According to one or more aspects of the present disclosure, gathering manifold 28 comprises multiple intake connections at which the multiple ESPs are fluidicly connected. Gathering manifold 28 can include valves 45 (e.g., a one-way auto lift valve) for directing the flow of the energized fluid from each operating ESP 26 into and through manifold 28, and to close and to block the back flow of fluid into the inoperative (e.g., shut off) ESPs 26 from manifold 28.

In the depicted embodiment, electrical power is provided to ESP motors 34 from the exterior of ESP module 12 (e.g., housing 44) through a module head 46 (e.g., power head, electrical head, termination head, etc.). In the depicted embodiment, electrical cables 48 connect each ESP motor 34 to electrical connector 50 (e.g., wet mate connector, dry mate connector) at the interior side of module head 46. An electrical power source 53 (FIG. 1) removed from the subsea location of ESP module 12, for example located at the surface, the seabed, or subsea; is electrically connected via an umbilical 52 (e.g., submarine cable, one or more cables) to ESP motors 34 for example through a wet connection at connector 50 of module head 46 (e.g., power head). In some embodiments, such as depicted in FIG. 2, umbilical 52 is a submarine cable that is connected at junction box 54 (e.g., multiple switches) which is electrically connected to electrical connector 50 via jumpers 56. Depicted junction box, for example a junction box c/w switch, can be deployed, for example, with ESP module 12 (e.g., housing 44), a valve tree or the like. Umbilical 52 can be connected to ESP module 12 subsea, for example, by a remotely operated vehicle ("ROV") 60. Electrical operation of ESP module 12 can be provided in some embodiments by a single cable in umbilical 52 from a variable speed drive ("VSD") 58 (FIG. 1) connected to the switches at junction box 54 for selective operation of each ESP motor 34. In some embodiments, each ESP motor 34 may be operationally connected to a dedicated VSD 58 to enable independent operation of each ESP motor 34.

An embodiment of a method for providing a multiple ESP pump system 10 in a subsea environment and for pumping a production fluid from a subsea environment is now described with reference to the figures. ESP module 12 is formed by mechanically securing two or more ESPs 26 together side by side to form a bundle 40, hydraulically connecting each of the bundled ESPs 26 in parallel to discharged energized fluid to a common gathering manifold 28, disposing the unit in a housing 44, electrically connecting the ESP motors 34 to a module head 46, and closing housing 44 (e.g., securing cap 43). ESP module 12 can be formed at the surface and deployed subsea, or deployed as disconnected components and assembled subsea. ESP module 12 can be deployed subsea in a production well 8, embedded in seabed 20 for example as depicted in FIGS. 1 and 2, or deployed on seabed 20, for example on a skid. ESP module 12 can be deployed to the subsea location in various manners which will be understood by those skilled in the art with benefit of the present disclosure. For example, in some embodiments ESP module 12 is deployed from a platform, such as depicted collection point 16, for example from a crane or derrick (see FIG. 1). The ESP module 12 can be deployed via a cable or a tubular string (e.g., conduit). In some embodiments, the ESP module 12 can be deployed via export conduit 14 or export conduit 14 can be fluidicly connected, subsea, to ESP module 12. In other embodiments, ESP module 12 is deployed from a motorized vessel not shown. Once deployed subsea, ESP module 12 is connected to an inflow of production fluid 5 via inflow conduit 24 extending from a production fluid 5 source, such as production well 8. In some embodiments, export conduit 14 is fluidicly connected to common gathering manifold 28 for example through module header 46. Electrical power and control can be connected to ESP module 12 subsea. Subsea assembly and connections can be performed, for example, with ROV 60 and/or divers.

In operation, production fluid 5 is directed into housing 44 through inflow conduit 24 wherein it is drawn through pump inlets 32 of each of the operating (e.g., on) ESPs 26 which respectively energize and discharge the production fluid into gathering manifold 28 and then export conduit 14 thereby pumping the production fluid to collection point 16. Control commands can be communicated, for example via VSD 58 and umbilical 52, to selectively operate one or more of the ESPs 26*a*, 26*b*, 26*c*. For example, one ESP 26 can be switched off (e.g., shutdown) and the other ESPs can be switched on. In another example, the speed of individual ESP motors 34 can be selectively controlled.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A multiple electric submersible pump ("ESP") system, the system comprising:

a first ESP having an intake, a discharge, a pump, and an electric motor;

a second ESP having an intake, a discharge, a pump, and an electric motor, wherein the first ESP discharge and the second ESP discharge are connected in parallel to a common manifold, and wherein the first ESP and the second ESP are secured together in a bundle by a mechanical connector; and a sealed caisson located at a seabed and having an inflow port through which fluid is received into the sealed caisson, wherein the bundle of first and second ESPs is located in the sealed caisson such that the pump and the electric motor of each of the first and second ESPs is below the seabed, the first and second ESPs being operable to pump the fluid through the common manifold, out of the caisson, and into an export conduit.

2. The system of claim 1, wherein the first ESP and the second ESP are disposed in a housing.

3. The system of claim 1, wherein the common manifold comprises a valve permitting fluid to flow through the valve only in the direction from the discharge of the discharge of the second ESP into the common manifold.

4. The system of claim 1, wherein the first ESP, the second ESP, and the manifold are contained in a housing.

5. The system of claim 4, further comprising a power head to connect, subsea, an electrical source to the first ESP and the second ESP contained in the housing.

6. A method for pumping a production fluid from a subsea environment, comprising:

hydraulically connecting multiple electrical submersible pumps ("ESP") in parallel to a common manifold, each ESP comprising a pump, an electric motor, and a motor protector;

enclosing the multiple ESPs and the common manifold into a housing forming an ESP module;

after forming the ESP module with the ESPs, the common manifold, and the housing, deploying the ESP module to a subsea location;

positioning the ESP module in a borehole formed in the seabed;

fluidicly connecting, subsea, the production fluid to the ESP module; and pumping the production fluid into the common manifold and to a collection point remote from the ESP module using the multiple ESPs.

7. The method of claim 6, further comprising fluidicly connecting, subsea, an export conduit to the common manifold.

8. The method of claim 6, further comprising electrically connecting, subsea, an electrical power source to the multiple ESPs.

9. The method of claim 6, further comprising selectively operating the multiple ESPs.

10. The method of claim 9, wherein selectively operating comprises switching off one of the multiple ESPs.

11. The method of claim 6, further comprising:

fluidicly connecting, subsea, an export conduit to the common manifold; and electrically connecting, subsea, an electrical power source to the multiple ESPs.

12. The method of claim 11, wherein the subsea location comprises a borehole formed in the seabed.

13. The method of claim 11, further comprising selectively operating the multiple ESPs.

14. The method of claim 13, wherein the selectively operating comprises switching off one of the multiple ESPs.

15. The method of claim 6, wherein the hydraulically connecting the multiple ESPs in parallel to a common manifold is performed at a location remote from the offshore subsea location.

16. The method of claim 6, wherein enclosing is performed at a location remote from the offshore subsea location.

17. A method for subsea fluid production, comprising:

securing a first electrical submersible pump ("ESP") and a second ESP side by side to form a bundle, wherein each of the first ESP and the second ESP comprise a pump having an intake and a discharge, and an electric motor;

connecting the discharges of the first ESP and the second ESP in parallel to a manifold;

enclosing the ESP bundle and the manifold in a sealed housing to form an ESP module;

lowering the ESP module from a sea surface and positioning the ESP module at least partially in a seabed at a subsea location;

directing a production fluid into the housing;

drawing the production fluid from inside of the housing into the intakes of the first ESP and the second ESP; and pumping the production fluid from both the discharge of the first ESP and the discharge of the second ESP into the manifold and to a collection location remote from the ESP bundle.

18. The method of claim 17, further comprising electrically connecting an umbilical to the ESP bundle; and controlling operation of the first ESP and the second ESP in response to signals communicated via the umbilical.

* * * * *